US010488794B2

(12) United States Patent
Wakatsu et al.

(10) Patent No.: US 10,488,794 B2
(45) Date of Patent: Nov. 26, 2019

(54) IMAGE FORMING APPARATUS THAT SWITCHES POWER SUPPLY TO PLURALITY OF HEATING ELEMENTS

(71) Applicant: CANON KABUSHIKI KAISHA, Tokyo (JP)

(72) Inventors: Kohei Wakatsu, Kawasaki (JP); Kazuhiro Doda, Yokohama (JP); Tsuguhiro Yoshida, Yokohama (JP); Yutaka Sato, Komae (JP); Ken Oi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/195,554

(22) Filed: Nov. 19, 2018

(65) Prior Publication Data

US 2019/0163100 A1 May 30, 2019

(30) Foreign Application Priority Data

Nov. 27, 2017 (JP) ..... 2017-226895

(51) Int. Cl.
*G03G 15/20* (2006.01)

(52) U.S. Cl.
CPC ..... *G03G 15/205* (2013.01); *G03G 15/2042* (2013.01); *G03G 15/2053* (2013.01); *G03G 15/2064* (2013.01); *G03G 2215/2035* (2013.01)

(58) Field of Classification Search
CPC ..... G03G 15/2039; G03G 15/2042; G03G 15/205; G03G 15/2053; G03G 15/2064; G03G 2215/2006; G03G 2215/2035
See application file for complete search history.

(56) References Cited

U.S. PATENT DOCUMENTS

2003/0219271 A1* 11/2003 Kinouchi ..... G03G 15/2042 399/69
2008/0131160 A1* 6/2008 Mitsuoka ..... G03G 15/2039 399/70
2010/0142986 A1* 6/2010 Davidson ..... G03G 15/2042 399/69
2011/0164890 A1* 7/2011 Ota ..... G03G 15/2042 399/43
2012/0148283 A1* 6/2012 Sano ..... G03G 15/2053 399/69
2015/0086231 A1* 3/2015 Bush ..... G03G 15/2042 399/69
2015/0220029 A1* 8/2015 Samei ..... G03G 15/2039 399/69

FOREIGN PATENT DOCUMENTS

JP 06-003983 A 1/1994
JP 2001-100558 A 4/2001
JP 2001-255772 A 9/2001
JP 2003-076213 A 3/2003

* cited by examiner

*Primary Examiner* — Sophia S Chen
(74) *Attorney, Agent, or Firm* — Canon U.S.A., Inc. IP Division

(57) ABSTRACT

In a case where fixing processing ends in a state where a power supply line is switched by a switching unit according to a first print command so that power is suppliable to a second heating element, the switching unit switches the power supply line from the second heating element to a first heating element so that power is suppliable to the first heating element, the switching occurring regardless of presence or absence of reception of a second print command subsequent to the first print command.

10 Claims, 11 Drawing Sheets

IMAGE FORMING APPARATUS THAT SWITCHES POWER SUPPLY TO PLURALITY OF HEATING ELEMENTS

BACKGROUND

Field

The present disclosure relates to an image forming apparatus using an electrophotographic method, such as a copying machine or a printer.

Description of the Related Art

Japanese Patent Application Laid-Open No. 2001-100558 discusses an image forming apparatus which includes a plurality of heating elements having different longitudinal lengths. The image forming apparatus is able to control which heating element or elements receives power by performing switching using a switching unit such as a relay. That is, the image forming apparatus exclusively switches, by using the switching unit, the heating elements to be powered. A temperature increase of a non-sheet-passing portion can be suppressed by having the image forming apparatus switch to provide a power supply to a heating element having a length corresponding to the size of a recording material currently being used in image forming processing, and having the image forming apparatus perform fixing processing using the heating element with the length corresponding to such a recording material.

Assume a situation where image forming processing ends in a state where power can be supplied to a last used heating element. If the heating element to be used for the next image forming processing is a heating element having a different longitudinal length than the last used heating element, the supply of power may need to be switched to provide power to a new heating element in connection with performing the next image forming processing. In such situations, the time required for warming up a fixing unit for performing fixing processing may increase in duration.

SUMMARY

According various embodiments of the present disclosure, an image forming apparatus includes an image forming unit configured to form an image on a recording material, a fixing unit including a rotation member and a heater configured to heat the rotation member, the heater including a plurality of heating elements including a first heating element and a second heating element having a length smaller than that of the first heating element in a longitudinal direction of the rotation member, the fixing unit being configured to perform fixing processing to fix the image to the recording material by using heat of the heater, via the rotation member, and a switching unit configured to switch a power supply line so that power is suppliable to any one of the plurality of heating elements, wherein, in a case where the fixing processing ends in a state where the power supply line is switched by the switching unit according to a first print command so that power is suppliable to the second heating element, the switching unit switches the power supply line from the second heating element to the first heating element so that power is suppliable to the first heating element, the switching occurring regardless of presence or absence of reception of a second print command subsequent to the first print command.

Further features will become apparent from the following description of exemplary embodiments with reference to the attached drawings.

DESCRIPTION OF THE EMBODIMENTS

Figure 1:
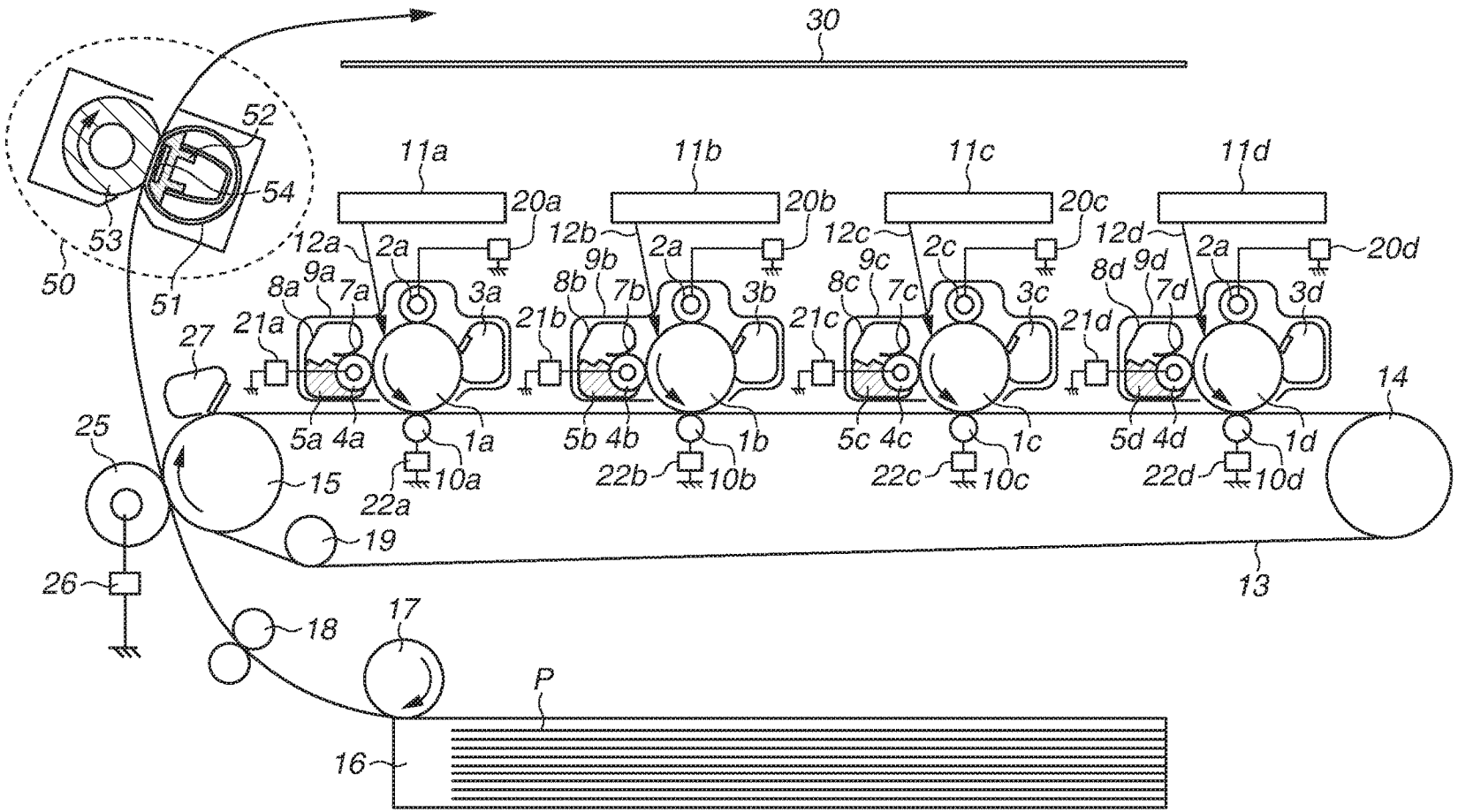
FIG. 1 is a schematic sectional view of an image forming apparatus according to a first exemplary embodiment.

A first exemplary embodiment will be described. FIG. 1 is a configuration diagram illustrating an inline color image forming apparatus which is an example of an image forming apparatus including a fixing device according to the present exemplary embodiment.

An operation of the electrophotographic color image forming apparatus will be described with reference to FIG. 1.

First, second, third, and fourth stations are stations for forming toner images in yellow (Y), magenta (M), cyan (C), and black (K), respectively.

The first station includes a photosensitive drum 1*a* serving as an image bearing member. The photosensitive drum 1*a* includes a plurality of layers of functional organic materials stacked on a metal cylinder. The plurality of layers includes a carrier generation layer which generates electric charges when exposed to light, and a charge transport layer which transports the generated charges. The outermost layer has low electrical conductivity and is almost insulating. A charging roller 2*a* serving as a charging unit is in contact with the photosensitive drum 1*a*. As the photosensitive drum 1*a* rotates, the charging roller 2*a* is driven to rotate and uniformly charges the surface of the photosensitive drum 1*a*. A direct-current voltage or a direct-current voltage on which an alternating-current voltage is superposed is applied to the charging roller 2*a*. The photosensitive drum 1*a* is charged by the occurrence of a discharge in small air gaps upstream and downstream of a contact nip portion between the charging roller 2*a* and the surface of the photosensitive drum 1*a*. A cleaning unit 3*a* cleans transfer residual toner on the photosensitive drum 1*a*. A developing unit 8*a* includes a developing roller 4*a*, nonmagnetic one-component toner 5*a*, and a developer application blade 7*a*. The foregoing components

1*a*-5*a*,7*a* and 8*a* constitute an integrated process cartridge 9*a* which is detachably attachable to the image forming apparatus.

An exposure unit 11*a* includes a scanner unit which scans the photosensitive drum 1*a* with laser light by using a polygon mirror, or a light-emitting diode (LED) array. The exposure unit 11*a* irradiates the photosensitive drum 1*a* with a scanning beam 12*a* that is modulated based on an image signal.

The charging roller 2*a*, the developing roller 4*a*, and a primary transfer roller 10*a* are connected to a charging high-voltage power supply 20*a*, a developing high-voltage power supply 21*a*, and a primary transfer high-voltage power supply 22*a*, respectively, which are units for supplying voltages.

The first station has the configuration described above. The second, third, and fourth stations have similar configurations. Parts having similar functions to those of the first station are designated by the same numbers, followed by symbols b, c, and d for the respective stations.

An intermediate transfer belt 13 is supported by three rollers serving as stretching members. The three rollers are a secondary transfer counter roller 15, a tension roller 14, and an auxiliary roller 19. Force in the direction of stretching the intermediate transfer belt 13 is applied to only the tension roller 14 by a spring, whereby appropriate tension force is maintained on the intermediate transfer belt 13. The secondary transfer counter roller 15 is driven to rotate by a not-illustrated main motor, whereby the intermediate transfer belt 13 wound about the outer periphery is rotated. The intermediate transfer belt 13 moves at substantially the same speed in a forward direction with respect to the photosensitive drums 1*a* to 1*d*. The intermediate transfer belt 13 rotates in the direction of the arrow. The primary transfer roller 10*a* is arranged opposite to the photosensitive drum 1*a* with the intermediate transfer belt 13 therebetween, and is driven to rotate by the movement of the intermediate transfer belt 13.

The auxiliary roller 19, the tension roller 14, and the secondary transfer counter roller 15 are electrically grounded. The primary transfer rollers 10*b*, 10*c*, and 10*d* of the second to fourth stations have a similar configuration to that of the primary transfer roller 10*a* of the first station. A description thereof will thus be omitted.

An image forming operation according to the present exemplary embodiment will be described. If the image forming apparatus receives a print (image formation) command in a standby state, the image forming apparatus starts an image forming operation. The photosensitive drums 1*a* to 1*d* and the intermediate transfer belt 13 start to be rotated in the directions of the arrows at a predetermined process speed by the not-illustrated main motor. The photosensitive drum 1*a* is uniformly charged by the charging roller 2*a*. An electrostatic latent image according to image information is then formed on the photosensitive drum 1*a* by the scanning beam 12*a* from the exposure unit 11*a*. The toner 5*a* in the developing unit 8*a* is negatively charged by the developer application blade 7*a*, and applied to the developing roller 4*a*. A predetermined bias is supplied to the developing roller 4*a* from the developing high-voltage power supply 21*a*. If the photosensitive drum 1*a* rotates and the electrostatic latent image formed on the photosensitive drum 1*a* reaches the developing roller 4*a*, the electrostatic latent image is visualized by the toner 5*a* of negative polarity, whereby a toner image in a first color (in the present exemplary embodiment, yellow) is formed on the photosensitive drum 1*a*. The stations of the other colors perform similar operations. Electrostatic latent images are formed on the respective photosensitive drums 1*a* to 1*d* by exposure while write signals from a controller are delayed at constant timing color by color according to distances between primary transfer positions of the respective colors. A direct-current (DC) high voltage of opposite polarity to that of the toners 5*a* to 5*d* is applied to the primary transfer rollers 10*a* to 10*d*. By the steps described above, the stations transfer the toner images to the intermediate transfer belt 13 in order, whereby a multiple toner image is formed on the intermediate transfer belt 13. A recording material P stacked in a recording material cassette 16 is then picked up by a feed roller 17 according to the formation of the multiple toner image, and conveyed to a registration roller 18 by a not-illustrated conveyance roller. The recording material P is conveyed to a transfer nip portion, which is a contact portion between the intermediate transfer belt 13 and a secondary transfer roller 25, by the registration roller 18 in synchronization with the multiple toner image on the intermediate transfer belt 13. A bias of opposite polarity to that of the toners 5*a* to 5*d* is applied to the secondary transfer roller 25 by a secondary transfer high-voltage power supply 26. The four-color multiple toner image borne on the intermediate transfer belt 13 is secondarily transferred to the recording material P in a collective manner.

After the end of the secondary transfer, secondary transfer residual toner remaining on the intermediate transfer belt 13 is cleaned by the cleaning unit 27. The recording material P after the end of the secondary transfer is conveyed to a fixing device 50 so that the multiple toner image is fixed to the recording material P, and discharged to a discharge tray 30 as an image-formed product (print, copy).

Figure 2:
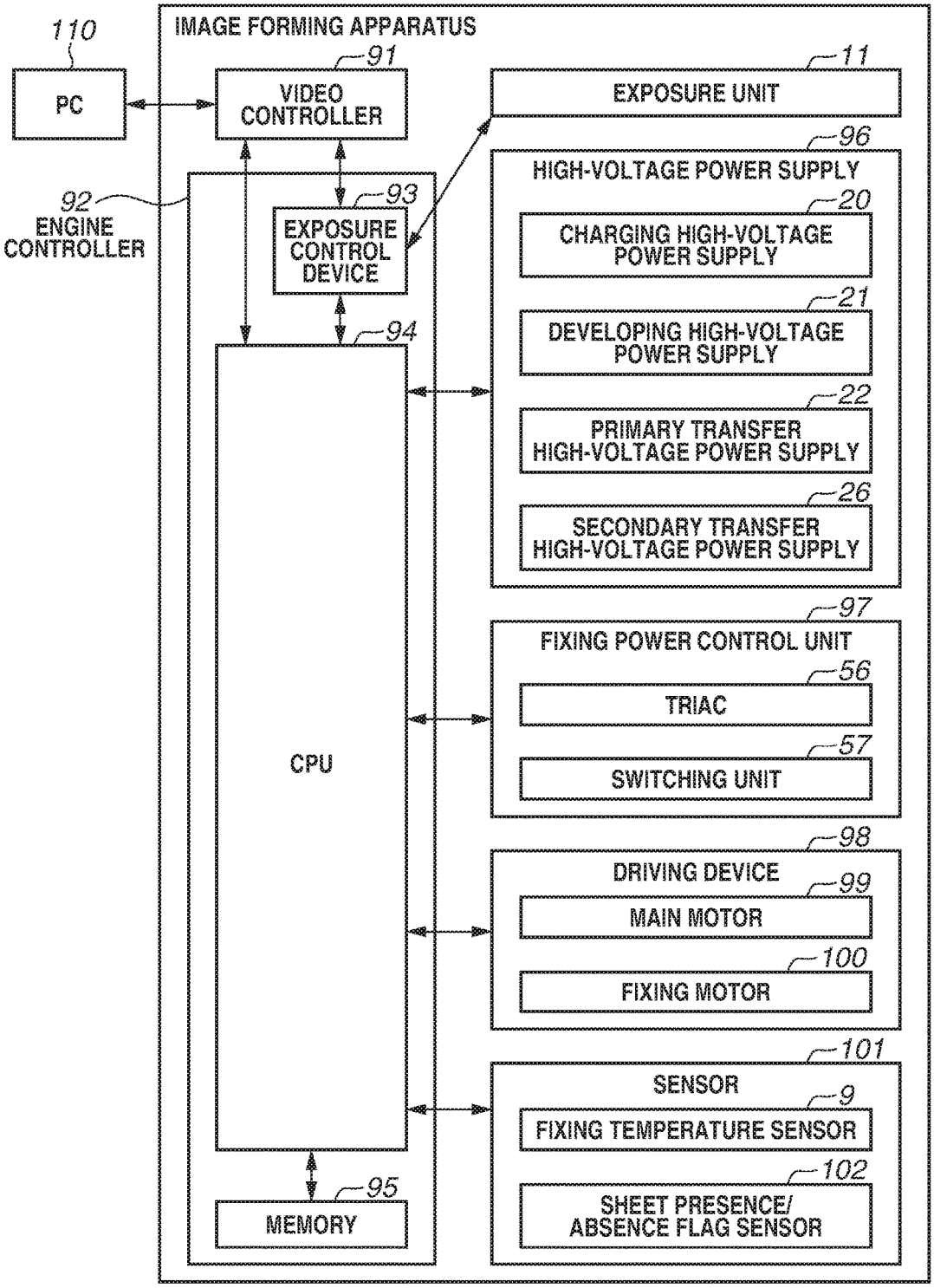
FIG. 2 is a block diagram for describing an operation of the image forming apparatus according to the first exemplary embodiment.

FIG. 2 is a block diagram for describing an operation of the image forming apparatus. A printing operation of the image forming apparatus will be described with reference to FIG. 2.

A personal computer (PC) 110 which is a host computer has the role of issuing a printing instruction to a video controller 91 included in the image forming apparatus, and transferring image data on a print image to the video controller 91.

The video controller 91 converts the image data from the PC 110 into exposure data, and transfers the exposure data to an exposure control device 93 included in an engine controller 92. The exposure control device 93 is controlled by a central processing unit (CPU) 94, and switches on/off the exposure data and controls the exposure units 11*a* to 11*d*. The CPU 94 starts an image formation sequence upon receiving a printing instruction.

The engine controller 92 includes the CPU 94 and a memory 95, and performs preprogrammed operations. A high-voltage power supply 96 includes the charging high-voltage power supplies 20*a* to 20*d*, the developing high-voltage power supplies 21*a* to 21*d*, the primary transfer high-voltage power supplies 22*a* to 22*d*, and the secondary transfer high-voltage power supply 26. A fixing power control unit 97 includes a triac 56 which serves as a power control unit, and a switching unit 57 which exclusively switches heating elements to be powered. A driving device 98 includes a main motor 99 and a fixing motor 100. A sensor 101 includes a fixing temperature sensor 9 which detects a temperature of the fixing device 50, and a sheet presence/absence flag sensor 102 which detects the presence or absence of a sheet. Detection results of the sensor 101 are transmitted to the CPU 94. The CPU 94 obtains the detection results of the sensor 101 in the image forming apparatus, and controls the exposure units 11*a* to 11*d*, the high-voltage power supply 96, the fixing power control unit 97, and the driving device 98. The formation of electrostatic latent images, the transfer of developed toner images, and the fixing of the toner images to a recording material P are thereby performed.

A configuration of the fixing device 50 according to the present exemplary embodiment will be described with reference to FIGS. 3 to 6. A longitudinal direction refers to the width direction of a recording material P, which is a direction perpendicular to a conveyance direction of the recording material P to be described below. The longitudinal direction coincides with that of a film 51 or a rotation axis direction of a pressure roller.

Figure 3:
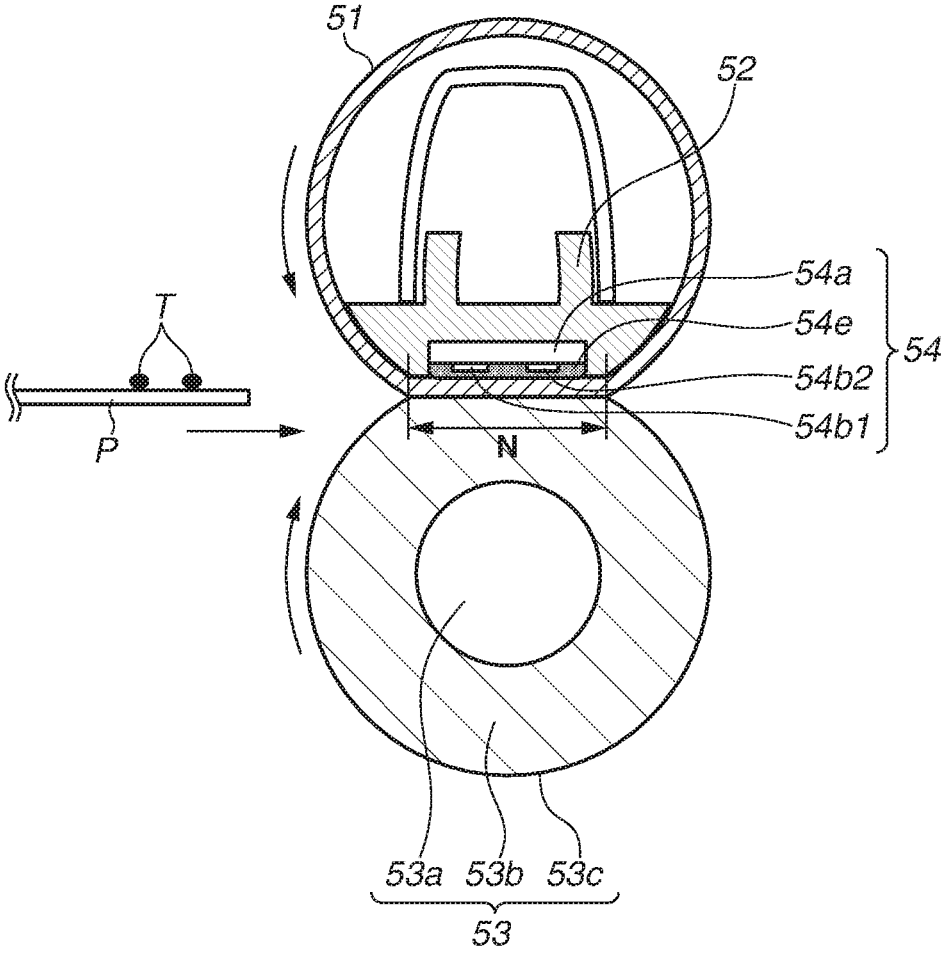
FIG. 3 is a schematic sectional view near a longitudinal center of a fixing device according to the first exemplary embodiment.
Figure 4:
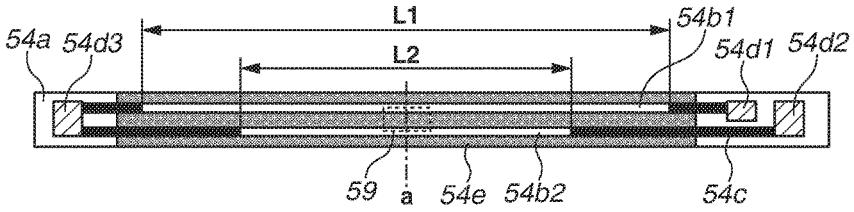
FIG. 4 is a schematic front view of a heater according to the first exemplary embodiment.
Figure 5:
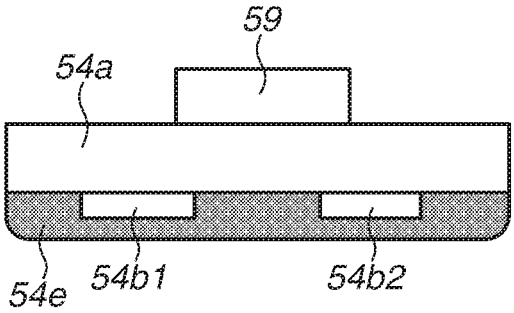
FIG. 5 is a schematic sectional view of the heater according to the first exemplary embodiment.
Figure 6:
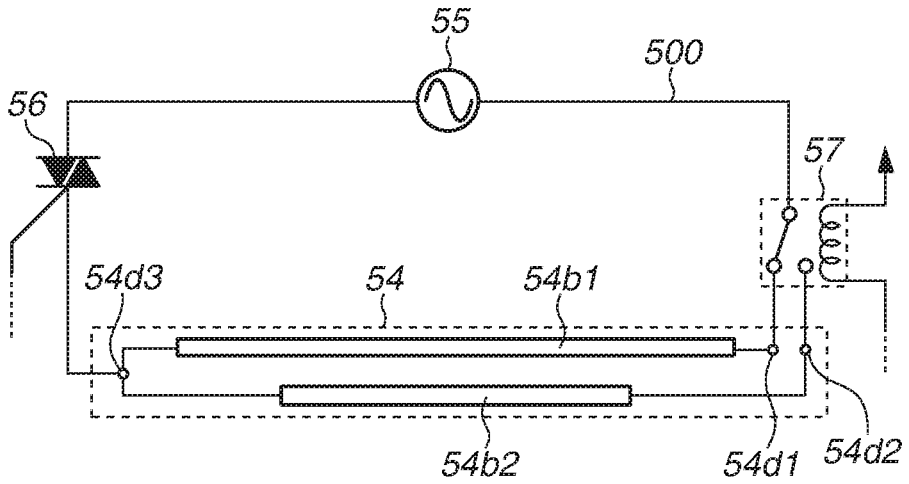
FIG. 6 is a schematic diagram illustrating a power control circuit of the fixing device according to the first exemplary embodiment.

FIG. 3 is a schematic sectional view of the fixing device 50. FIG. 4 is a schematic front view of a heater. FIG. 5 is a schematic sectional view of the heater. FIG. 6 is a schematic circuit diagram of a control unit of the fixing device 50.

In FIG. 3, a recording material P bearing a toner image T from the left is conveyed and heated through a fixing nip portion N, whereby the toner image T is fixed to the recording material P. The fixing device 50 according to the present exemplary embodiment includes the film 51 of a cylindrical shape, a nip forming member 52, a pressure roller 53, and a heater 54. The nip forming member 52 holds the film 51. The pressure roller 53 forms the fixing nip portion N with the film 51. The heater 54 is configured to heat the recording material P.

The film 51 is a fixing film serving as a heating rotation member. In the present exemplary embodiment, the film 51 includes a base layer made of polyimide. An elastic layer made of silicone rubber and a releasing layer made of perfluoroalkoxy alkane (PFA) are formed on the base layer. Grease is applied to the inner surface of the film 51 to reduce frictional force occurring between the nip forming member 52, the heater 54, and the film 51 due to rotation of the film 51.

The nip forming member 52 plays a role in guiding the film 51 from inside and forming the fixing nip portion N with the pressure roller 53 via the film 51. The nip forming member 52 is a rigid, heat-resistant, heat-insulating member, and is made of a liquid crystal polymer. The film 51 is fitted onto the nip forming member 52.

The pressure roller 53 serves as a pressing rotation member. The pressure roller 53 includes a metal core 53*a*, an elastic layer 53*b*, and a releasing layer 53*c*. The pressure roller 53 is rotatably held at both ends and is driven to rotate by the fixing motor 100. The film 51 is driven to rotate by the rotation of the pressure roller 53. In other words, the fixing motor 100 transmits driving force for driving the film 51.

The heater 54 serves as a heating member. The heater 54 is held by the nip forming member 52 and is in contact with the inner surface of the film 51.

The heater 54 will be described in detail with reference to FIGS. 4 and 5. FIG. 5 is a diagram illustrating a cross section of the heater 54, taken along the longitudinal center line (in FIG. 4, the line a) of heating elements 54*b*1 and 54*b*2.

The heater 54 includes a substrate 54*a*, the heating elements 54*b*1 and 54*b*2, conductors 54*c*, contacts 54*d*1 to 54*d*3, and a protective glass layer 54*e*. The heating elements 54*b*1 and 54*b*2, the conductors 54*c*, and the contacts 54*d*1 to 54*d*3 are formed on the substrate 54*a*. The protective glass layer 54*e* is formed thereon to ensure insulation between the heating elements 54*b*1 and 54*b*2 and the film 51. The heating elements 54*b*1 and 54*b*2 are formed to extend in the longitudinal direction of the film 51.

The heating element 54*b*1 has a longitudinal length L1 which is the largest among the longitudinal lengths of the plurality of heating elements 54*b*1 and 54*b*2 included in the heater 54. The heating element 54*b*2 has a longitudinal length L2 smaller than the longitudinal length L1 of the heating element 54*b*1. The longitudinal length L1 of the heating element 54*b*1 is a length that enables fixing of a recording material having a widest width among regular-sized recording materials usable in the image forming apparatus. The heating element 54*b*1 is electrically connected to the contacts 54*d*1 and 54*d*3 via conductors 54*c*. The heating elements 54*b*2 is electrically connected to the contacts 54*d*2 and 54*d*3 via conductors 54*c*.

A fixing temperature sensor 59 is located on a surface of the substrate 54*a* opposite from the protective glass layer 54*e*. The fixing temperature sensor 59 is installed at the longitudinal center of the heating elements 54*b*1 and 54*b*2 and in contact with the substrate 54*a*. The fixing temperature sensor 59 is a thermistor. The fixing temperature sensor 59 detects the temperature of the heater 54 and transmits the detection result to the CPU 94.

FIG. 6 is a schematic diagram of a power control circuit of the fixing device 50. The power control circuit of the fixing device 50 includes the heating elements 54*b*1 and 54*b*2, an alternating-current power supply 55, a power supply line 500, the triac 56, and the switching unit 57. The switching unit 57 is provided in the middle of the power supply line 500 which electrically connects the alternating-current power supply 55 with the heating element 54*b*1 or 54*b*2.

The triac 56 turns on/off electricity from the alternating-current power supply 55 to the heating elements 54*b*1 and 54*b*2. The CPU 94 calculates power needed to achieve a target temperature from temperature information notified by the thermistor 59, and instructs the triac 56 to turn on/off the electricity.

In the present exemplary embodiment, the switching unit 57 is a Form C contact relay. The switching unit 57 is configured to exclusively select either the heating element 54*b*1 or the heating element 54*b*2, as a heating element to which power is to be supplied. The switching unit 57 connects to either one of the contacts 54*d*1 and 54*d*2, i.e., switches the power supply line 500. The switching unit 57 performs such switching according to a signal from the CPU 94. For the sake of convenience, switching the power supply line 500 so that power can be supplied to one of a plurality of heating elements will hereinafter be referred to as switching the heating elements or selecting the heating element. To prevent contact welding of the switching unit 57 which is a Form C contact relay, it is desirable that the switching unit 57 can switch the power supply line 500 in a state where the energization (power supply) of the heating element 54*b*1 or 54*b*2 by the triac 56 is turned off. In the present exemplary embodiment, the switching unit 57 is connected to the contact 54*d*1 when no power is supplied to the switching unit 57, such as when a power switch of the image forming apparatus main body is off.

Figure 7:
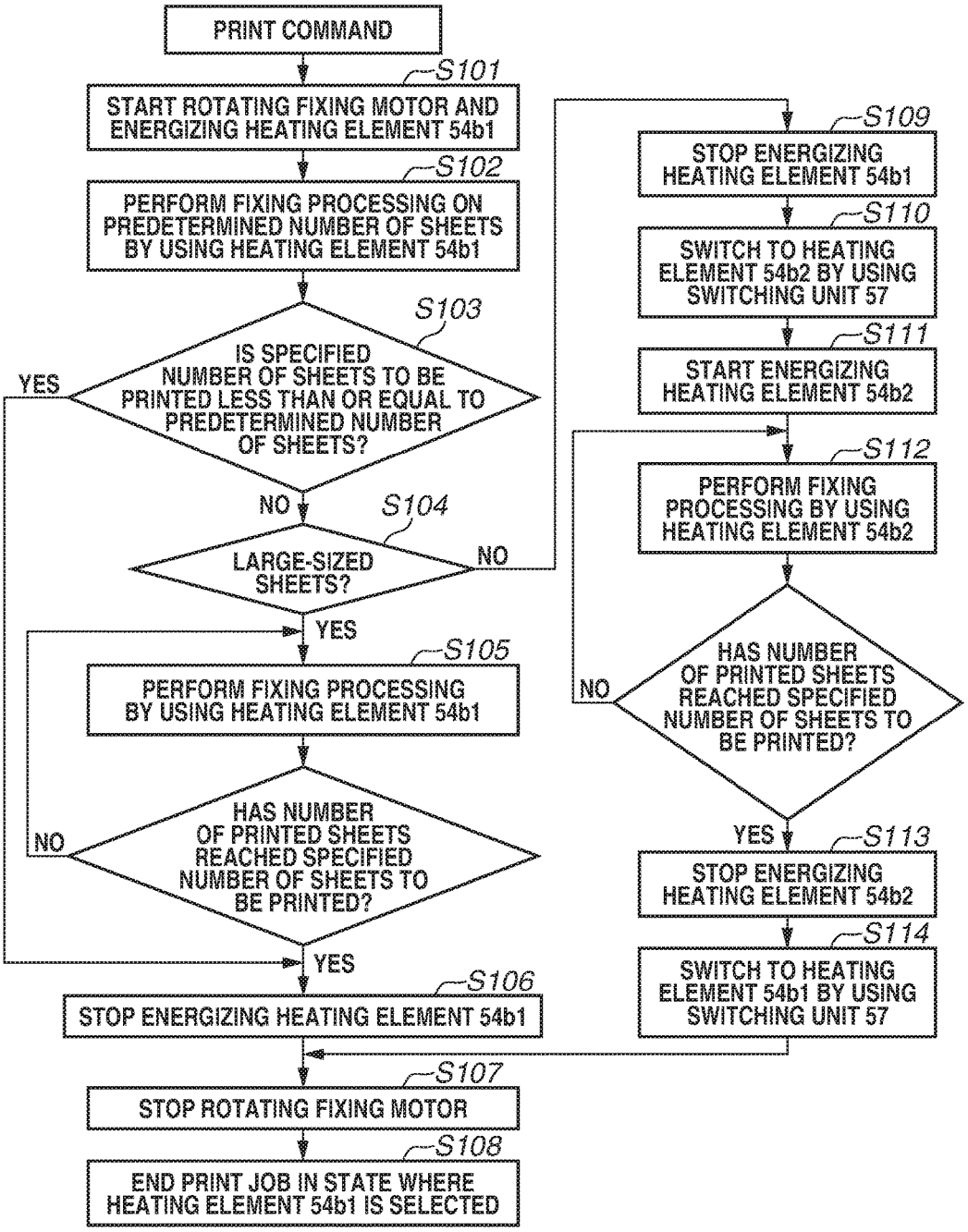
FIG. 7 is a flowchart of control according to the first exemplary embodiment.

Characteristics of the present exemplary embodiment will be concretely described with reference to FIG. 7. FIG. 7 is a flowchart illustrating timing of switching control on the heating elements 54*b*1 and 54*b*2 according to the present exemplary embodiment. Here, a sheet (recording material) having a width corresponding to the heating element 54*b*2 will be referred to as a small-sized sheet (small-sized recording material). A sheet (recording material) having a width corresponding to the heating element 54*b*1 will be referred to as a large-sized sheet (large-sized recording material).

In the present exemplary embodiment, the switching unit 57 is configured to switch the power supply line 500 to the heating element 54*b*1 having the largest longitudinal length and to end a received print job (image formation job) regardless of the presence or absence of reception of a print job subsequent to the received print job. This can reduce a warmup time since the heating element 54*b*1 can be energized (powered) immediately after reception of a command (print command) to form an image, without switching the heating elements 54*b*1 and 54*b*2. Regardless of the presence or absence of reception the next print job means that the switching unit 57 switches the power supply line 500 to the heating element 54*b*1 having the largest longitudinal length even if the next print job is not received yet and the size of the sheets to be used is unknown. There are the following advantages in performing fixing processing by using the heating element 54*b*1 having the largest longitudinal length, at least in an early stage of a print job for continuously printing a plurality of recording materials. For example, sheets having the maximum width usable in the image forming apparatus or having widths close to the maximum width are likely to be frequently used. If the image forming apparatus is left unused for a long time before reception of a print job, fixability at longitudinal ends of an image is likely to be low. The fixability at ends can be then improved by performing fixing processing by using the heating element 54*b*1 having the largest longitudinal length regardless of the sheet size, at least in the initial stage of the print job. Film deformation can be prevented by uniformly softening the grease spread over the inner surface of the film 51 along the longitudinal direction. The warmup time of the fixing device 50 can therefore be reduced if power can be supplied to the longest heating element 54*b*1 when a print command is received. According to the configuration of the present exemplary embodiment, it takes 0.2 seconds for the switching unit 57 to complete switching after issuance of a switching signal from the CPU 94. The warmup time can thus be reduced by 0.2 seconds if the power supply line 500 is not switched.

In the present exemplary embodiment, the heating element 54*b*1 is already selected when a print command is received. In step S101, rotating the fixing motor 100 and energizing the heating element 54*b*1 are then started. In step S102, fixing processing is performed on a predetermined number of sheets (in the present exemplary embodiment, three sheets) in the initial stage of the print job by using the heating element 54*b*1. In step S103, if the specified number of sheets to be printed of the print job is less than or equal to the predetermined number of sheets (YES in step S103), the processing proceeds to step S106 when the number of printed sheets has reached the specified number of sheets to be printed. In step S106, energizing the heating element 54*b*1 is stopped. In step S107, rotating the fixing motor 100 is stopped. In step S108, the print job is stopped in a state where power can be supplied to the heating element 54*b*1 (the heating element 54*b*1 is selected).

In step S103, if the predetermined number of sheets has been printed but the number of printed sheets has not reached the specified number of sheets to be printed of the print job (NO in step S103), the processing proceeds to step S104. The subsequent sequence varies depending on whether the sheets specified by the print job are large-sized sheets or small-sized sheets.

If large-sized sheets are specified (YES in step S104), the processing proceeds to step S105. In step S105, the fixing processing continues to be performed on the fourth and subsequent sheets after the initial three sheets by supplying power to the heating element 54*b*1. If the printing of the entire print job is completed, then in step S106, the triac 56 is used to turn off the energization. In step S107, the fixing motor 100 is stopped. In step S108, the operation is ended in the state where power can be supplied to the heating element 54*b*1.

On the other hand, if small-sized sheets are specified (NO in step S104), the processing proceeds to step S109 after the fixing processing on the initial three sheets ends. In step S109, the switching unit 57 switches the power supply line 500 to the heating element 54*b*2. Specifically, the triac is used to stop (turns off) energizing the heating element 54*b*1. In step S110, the switching unit 57 switches the power supply line 500 from the heating element 54*b*1 to the heating element 54*b*2. In step S111, the triac 56 is used to start (turns on) energizing the heating element 54*b*2. The energization by the triac 56 is stopped in order to prevent contact welding of the switching unit 57 which is a Form C contact relay. In the present exemplary embodiment, switching between the heating elements 54*b*1 and 54*b*2 is performed in an interval period between preceding and subsequent sheets, in which there is no sheet in the fixing nip portion N. In step S112, fixing processing is performed by using the heating element 54*b*2. In step S113, after the printing of the specified number of sheets to be printed of the print job is completed, the triac 56 is used to stop (turns off) energizing the heating element 54*b*2. In step S114, the switching unit 57 switches the power supply line 500 from the heating element 54*b*2 to the heating element 54*b*1. In step S107, the fixing motor 100 is stopped. In step S108, the print job is ended. In the present exemplary embodiment, the operation of steps S113 and S114 is performed after the end of the fixing processing while the fixing motor 100 is rotating. It is desirable that the switching by the switching unit 57 can be performed in a period when the main motor 99 and the fixing motor 100, which are the driving sources in the image forming apparatus, are rotating as in the present exemplary embodiment. The reason is to make the switching noise of the switching unit 57 less noticeable.

An operation and effect of the present exemplary embodiment will be described. A warmup time refers to the time of a period (warmup period) from when a print command is received to when the detection temperature of the thermistor 59 reaches a target temperature (temperature needed to fix a toner image T to a recording material P). A fixing conveyance time refers to the time of a period (fixing conveyance period) from when a print command is received to when a recording material P reaches the fixing nip portion N of the fixing device 50. If the warmup time is longer than the fixing conveyance time, the timing to convey the recording material P to the fixing device 50 needs to be delayed after the reception of the print command. This consequently increases a first print output time (FPOT) which is the time from the print command is received to when the first sheet is printed and discharged out of the image forming apparatus. If the warmup time is shorter than or equal to the fixing conveyance time, the FPOT of the image forming apparatus is determined by the fixing conveyance time, and the warmup time is not the rate-determining factor of the FPOT. In the present exemplary embodiment, the temperature of the fixing device 50 before a start of printing was 23° C. by actual measurement. The warmup time of the fixing device 50 was 4.0 sec in a case where the switching operation of the switching unit 57 was not needed. The fixing conveyance time was also 4.0 sec. If the switching between the heating elements 54*b*1 and 54*b*2 need to be performed by the switching unit 57 in warming up the fixing device 50, the warmup time increases by as much as the switching time. In the present exemplary embodiment, the time needed to perform the switching between the heating elements **54*b*1 and 54*b*2** was 0.2 sec, and the resulting FPOT was 4.2 sec.

Table 1 shows whether the switching between the heating elements **54*b*1 and 54*b*2 needs to be performed and the resulting warmup times in a case where the switching between the heating elements 54*b*1 and 54*b*2 is performed according to the flowchart illustrated in FIG. 7**.

TABLE 1

Presence or Absence of Switching and Warmup Time

| Sheet size | Selection of heating element: Standby period | Warmup period | Fixing processing period | End period | Switching between heating elements during warmup | Warmup time |
|---|---|---|---|---|---|---|
| Large-sized sheets | 54b1 | 54b1 | 54b1 | 54b1 | Not needed | 4.0 sec |
| Small-sized sheets | 54b1 | 54b1 | 54b1 → 54b2 | 54b1 | Not needed | 4.0 sec |

The standby period refers to a period of waiting after a print job ends until a print command for the next print job is transmitted with the fixing motor 100 stopped. The fixing processing period refers to a period from when the first sheet of a print job enters the fixing nip portion N to when the last sheet of the print job passes the fixing nip portion N. The end period refers to a period from when the fixing processing of all the sheets of a print job is completed to when the power supply to the heater 54 (heating elements **54*b*1 and 54*b*2) is stopped and the motors including the fixing motor 100** are stopped to end the print job.

As shown in Table 1, according to the present exemplary embodiment, the image forming apparatus is configured to switch the power supply line 500 so that power is supplied to the heating element **54*b*1, in advance of the end of a print job. This eliminates the need to perform switching by the switching unit 57 upon reception of the next print job. The resulting warmup times for both sheet sizes were thus 4.0 sec, whereby the FPOT was always able to be minimized. The film 51** was not deformed since the fixing nip portion N was warmed uniformly in the longitudinal direction during warmup.

A configuration according to a comparative example will be described for the sake of comparison between the present exemplary embodiment and the comparative example.

Figure 8:
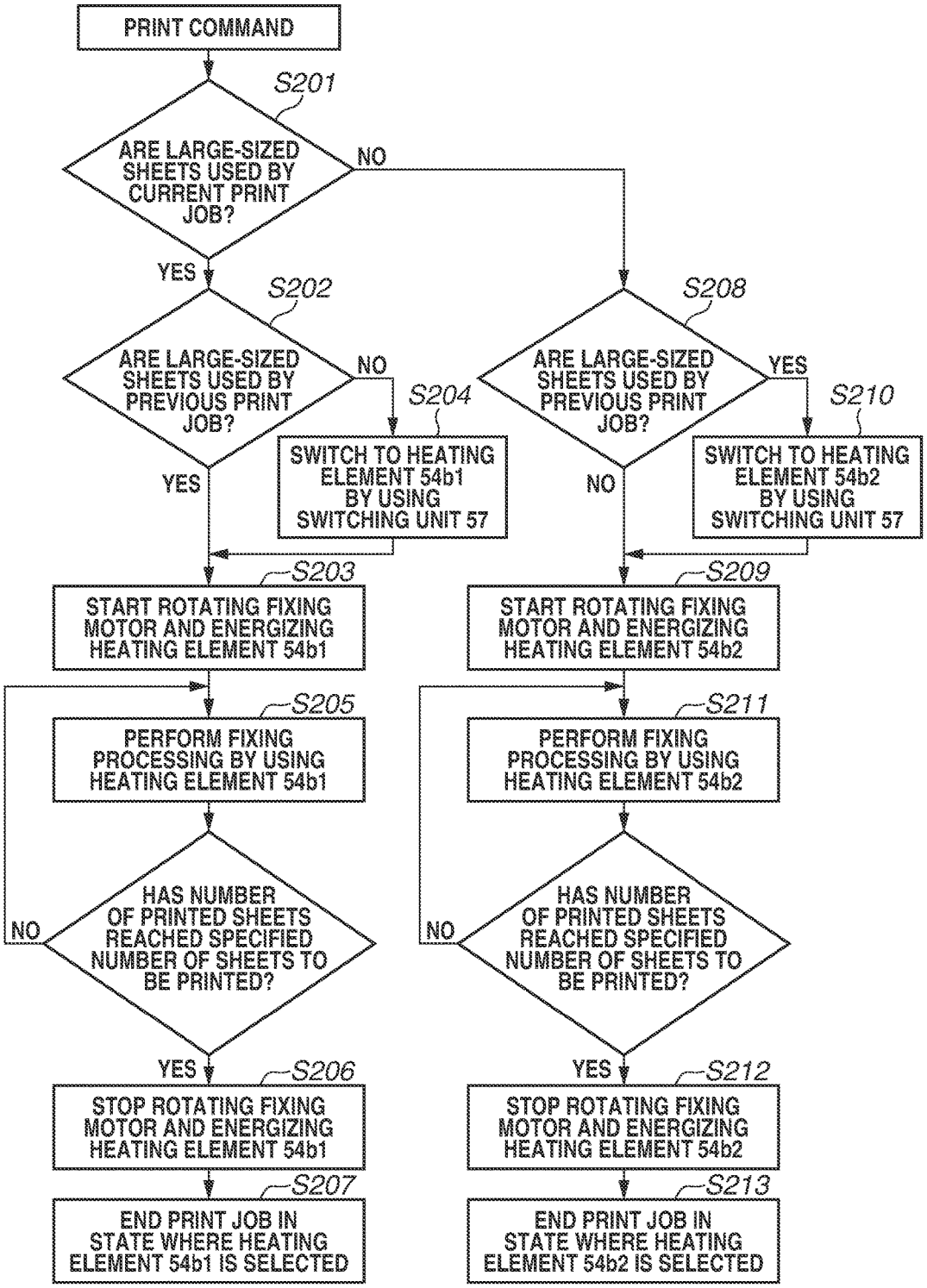
FIG.8 PRIOR ART
FIG. 8 is a flowchart of control according to a comparative example.

A description similar to that of the first exemplary embodiment will be omitted. In this comparative example, the switching between the heating elements **54*b*1 and 54*b*2 is not performed at the end of printing. If the previous print job uses large-sized sheets, the print job is ended in a state where power can be supplied to the heating element 54*b*1. If the previous print job uses small-sized sheets, the print job is ended in a state where power can be supplied to the heating element 54*b*2. FIG. 8 is a flowchart illustrating the timing of switching control on the heating elements 54*b*1 and 54*b*2** according to the comparative example.

In step S201, operation is performed to obtain information about which sheets are to be used for the current print job according to the print command, large-sized sheets or small-sized sheets. If large-sized sheets are to be used for the current print job (YES in step S201), the processing proceeds to step S202. In step S202, operation is performed to obtain information about which sheets are used for the previous print job, large-sized sheets or small-sized sheets. If large-sized sheets are used for the previous print job (YES in step S202), the processing proceeds to step S203. In step S203, since the heating element **54*b*1 is selected, the fixing motor 100 is turned on and energizing the heating element 54*b*1 is started. If small-sized sheets are used for the previous print job (NO in step S202), the processing proceeds to step S204. In step S204, since the heating element 54*b*2 is selected, the switching unit 57 switches the power supply line 500 to the heating element 54*b*1. In step S203, energizing the heating element 54*b*1 and rotating the fixing motor 100 are started. In step S205, fixing processing is performed by using the heating element 54*b*1. In step S206, after the printing of a specified number of sheets to be printed is completed, energizing the heating element 54*b*1 and rotating the fixing motor 100 are stopped. In step S207, the print job is ended in a state where the heating element 54*b*1** is selected.

A case where small-sized sheets are selected in step S201 (NO in step S201) will be described. The processing proceeds to step S208. In step S208, operation is performed to obtain information about which sheets are used for the previous print job, large-sized sheets or small-sized sheets. If small-sized sheets are used (NO in step S208), the processing proceeds to step S209. In step S209, since the heating element **54*b*2 is selected, the fixing motor 100 is simply turned on and energizing the heating element 54*b*2 is started. If large-sized sheets are used for the previous print job (YES in step S208), the processing proceeds to step S210. In step S210, the switching unit 57 switches the power supply line 500 to the heating element 54*b*2. In step S209, energizing the heating element 54*b*2 and rotating the fixing motor 100 are started. In step S211, fixing processing is performed by using the heating element 54*b*2. In step S212, after the printing of the specified number of sheets to be printed is completed, energizing the heating element 54*b*2 and rotating the fixing motor 100 are stopped. In step S213, the print job is ended in a state where the heating element 54*b*2** is selected.

Table 2 shows whether the switching between the heating elements **54*b*1 and 54*b*2 needs to be performed and the resulting warmup times according to the flowchart illustrated in FIG. 8**.

TABLE 2

Selection of Heating Element in Passing Sheets

| Sheet size | Previous print job | Selection of heating element: Standby period | Warmup period | Fixing processing period | End period | Switching between heating elements in starting warmup | Warmup time |
|---|---|---|---|---|---|---|---|
| Large-sized sheets | Large-sized sheets | 54b1 | 54b1 | 54b1 | 54b1 | Not needed | 4.0 sec |
| | Small-sized sheets | 54b2 | 54b1 | 54b1 | 54b1 | Needed | 4.2 sec |
| Small-sized sheets | Large-sized sheets | 54b1 | 54b2 | 54b2 | 54b2 | Needed | 4.2 sec |
| | Small-sized sheets | 54b2 | 54b2 | 54b2 | 54b2 | Not needed | 4.0 sec |

As shown in Table 2, the switching between the heating elements 54*b*1 and 54*b*2 needs to be performed in a case where small-sized sheets are specified for the previous print job and large-sized sheets are specified for the current print job or in a case where large-sized sheets are specified for the previous print job and small-sized sheets are specified for the current print job. Since the switching unit 57 switches the power supply line 500 between the heating elements 54*b*1 and 54*b*2 during the warmup period, the warmup time increases by as much as the time needed for switching (0.2 sec), i.e., was 4.2 sec.

As described above, in the comparative example, the switching unit 57 sometimes needs a switching time while the fixing device 50 shifts from the standby period to the warmup period, whereby the warmup time is increased. As a result, in the comparative example, the warmup time serves as the rate-determining factor in reducing the FPOT.

In the comparative example, the heating element 54*b*2 having a small longitudinal length is selected during the warmup period in a case where small-sized sheets are conveyed to the fixing device 50. The fixing nip portion N is therefore difficult to be warmed uniformly in the longitudinal direction. For this reason, the grease applied to the inner surface of the film 51 is then softened differently between the heated region and the not-heated regions of the film 51. As a result, a difference occurs longitudinally in the frictional force between the film 51 and the heater 54, and the film 51 can be deformed and damaged.

As described above, the configuration of the first exemplary embodiment provides the effect that the warmup time of the fixing device 50 can be made shorter than in the comparative example. The configuration in which grease is applied to the inner surface of the film 51 further provides an effect of preventing film deformation.

A second exemplary embodiment will be described. A description similar to that of the first exemplary embodiment will omitted. A configuration of the fixing device 50 according to the present exemplary embodiment will be described with reference to FIG. 9.

Figure 9:
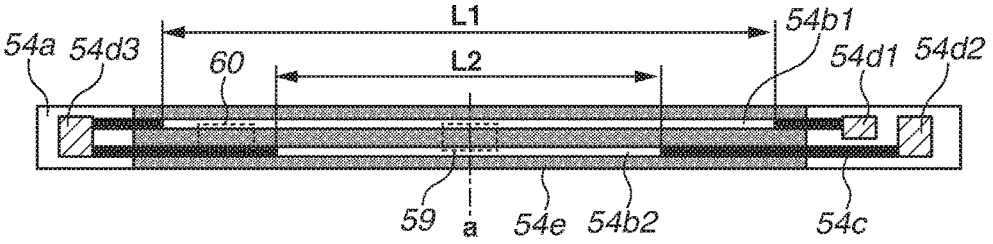
FIG. 9 is a schematic diagram illustrating a heater according to a second exemplary embodiment.

FIG. 9 is a schematic diagram illustrating the heater 54. A main thermistor 59 is a temperature detection member for detecting the temperature of a longitudinal center portion of the heater 54. A sub thermistor 60 is a temperature detection member for detecting the temperature of a longitudinal end portion of the heater 54. The main thermistor 59 and the sub thermistor 60 are arranged on a surface of the substrate 54*a* opposite to a surface where the protective glass layer 54*e* is formed, and are in contact with the substrate 54*a*. The main thermistor 59 is arranged at the longitudinal center of the heating elements 54*b*1 and 54*b*2. The sub thermistor 60 is arranged longitudinally inside of the heating element 54*b*1 and outside of the heating element 54*b*2.

The present exemplary embodiment is characterized in that the detection temperatures detected by the main thermistor 59 and the sub thermistor 60 are constantly monitored in the standby period, and whether to perform switching between the heating elements 54*b*1 and 54*b*2 is determined based on the detection temperatures detected by the thermistors 59 and 60. In a case where the detection temperatures are lower than or equal to a predetermined temperature, the switching unit 57 switches the power supply line 500 to the longest heating element 54*b*1.

The fixing device 50 may be warm at timing when a print job is received, for example, in a case where not much time has elapsed since the end of the previous print job. In such a case, the warmup time of the fixing device 50 is short. The warmup time of the fixing device 50 can thus be prevented from exceeding the fixing conveyance time even if the switching unit 57 performs switching after the reception of a print job. This can reduce the warmup time while reducing the number of times of switching of the switching unit 57. In the present exemplary embodiment, the CPU 94 monitors the detection temperature of the main thermistor 59 and the detection temperature of the sub thermistor 60 in the standby period. If either one of the detection temperatures is 50° C. or lower, the switching unit 57 switches the power supply line 500 so that power can be supplied to the heating element 54*b*1. By actual measurement, if both the detection temperature detected by the main thermistor 59 and the detection temperature detected by the sub thermistor 60 were higher than 50° C., the warmup time did not exceed the fixing conveyance time of 4.0 sec even if the switching operation was performed by the switching unit 57 during the warmup period.

Figures 10, 10A:
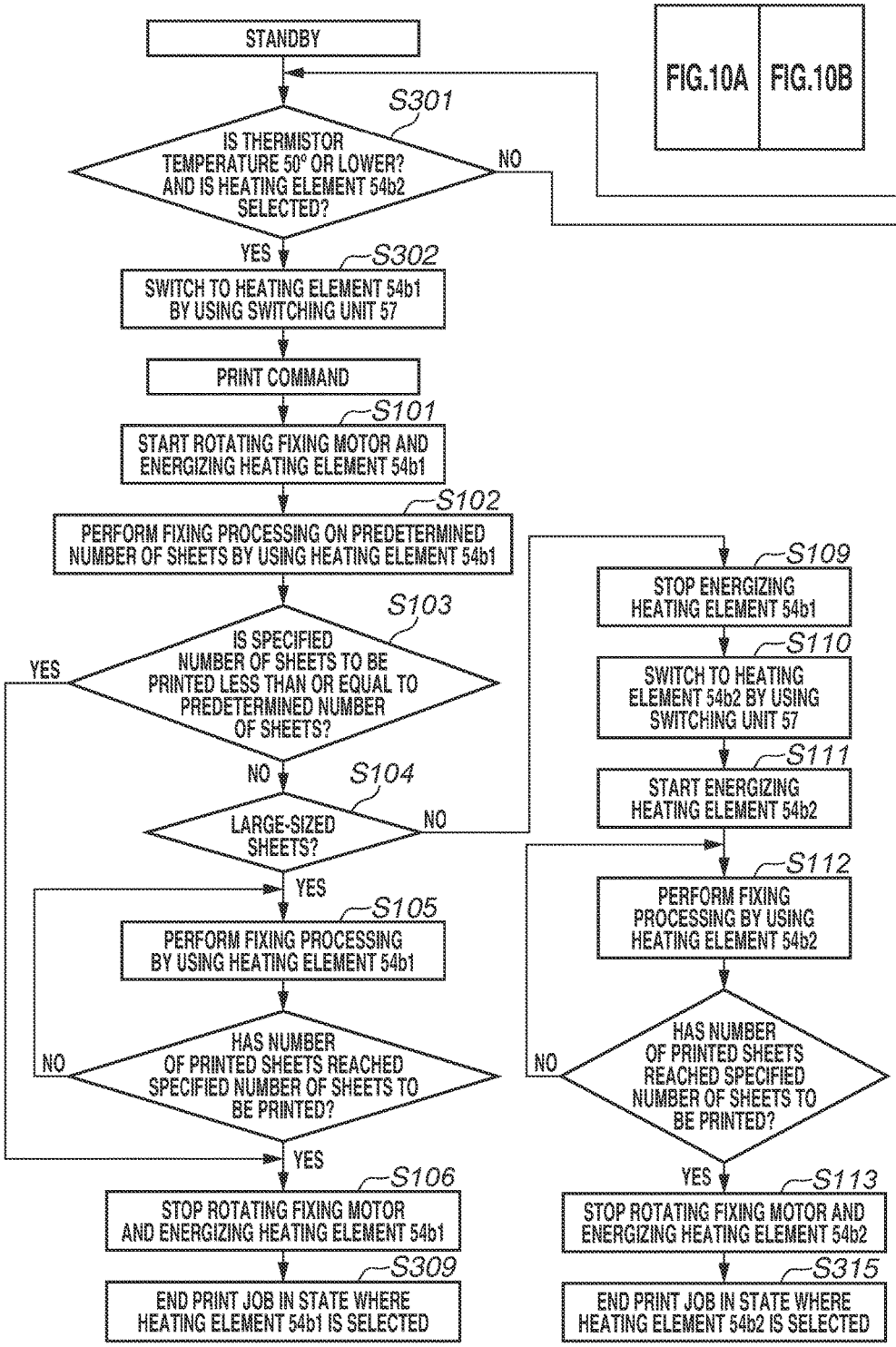
FIG. 10 (which includes FIG. 10A and FIG. 10B) is a flowchart of control according to the second exemplary embodiment.
Figure 10B:
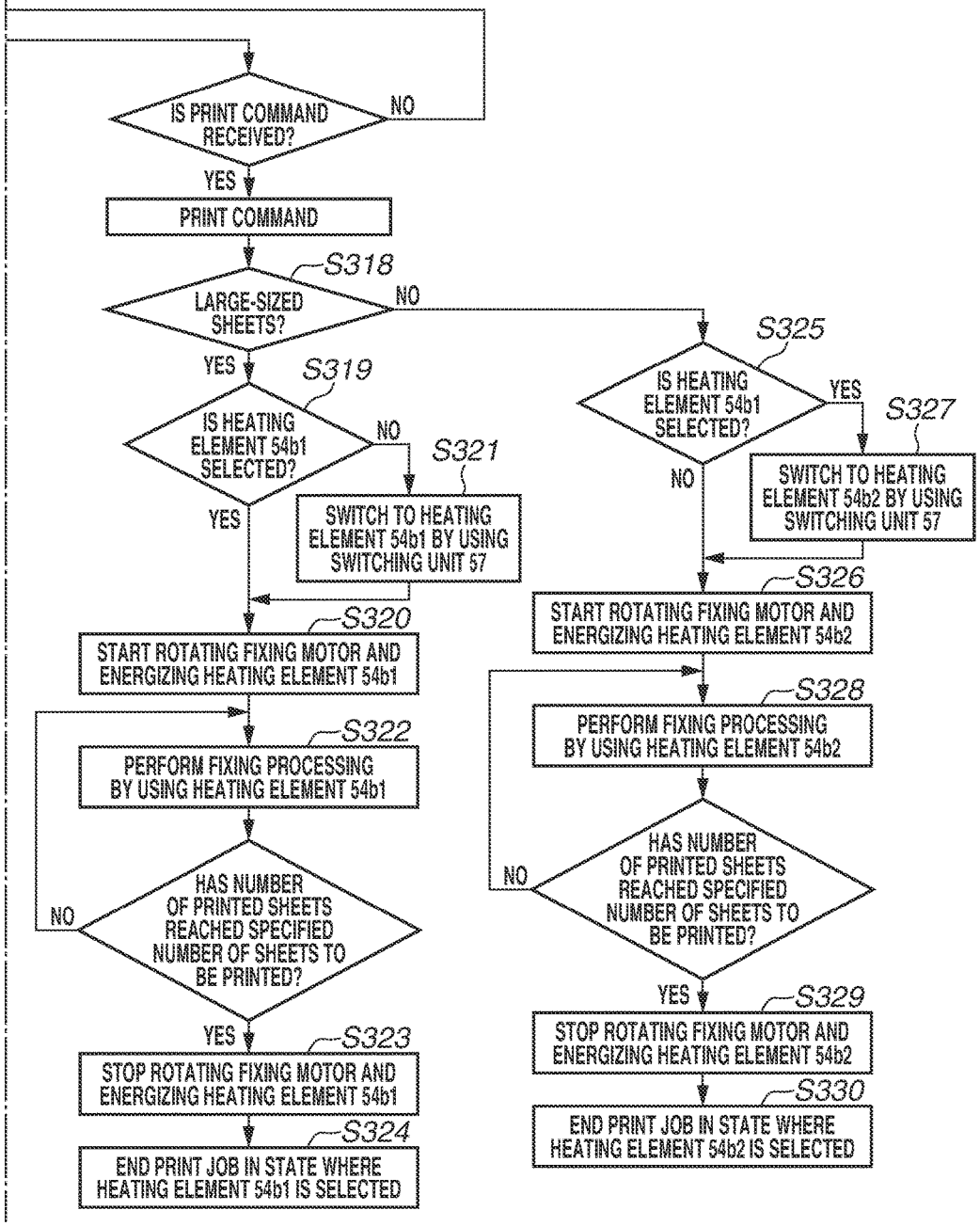

FIG. 10 is a flowchart illustrating the timing of switching control on the heating elements 54*b*1 and 54*b*2 according to the present exemplary embodiment. As employed herein, a thermistor temperature refers to the lower one of the detection temperatures detected by the main and sub thermistors 59 and 60.

In the present exemplary embodiment, the CPU 94 monitors the thermistor temperature in the standby period. In a case where the thermistor temperature is 50° C. or lower and the heating element 54*b*2 is selected (YES in step S301), the processing proceeds to step S302. In step S302, the switching unit switches the power supply line 500 to the heating element 54*b*1 during the standby period. Then, a print command is received. In a case where large-sized sheets are specified for the print job or in a case where small-sized sheets are specified and the specified number of sheets to be printed is less than or equal to a predetermined number of sheets (three), the processing eventually proceeds to step S309. In step S309, the print job is ended in the state where the heating element 54*b*1 is selected. In a case where small-sized sheets are specified for the print job and the specified number of sheets to be printed is more than three, the processing eventually proceeds to step S315. In step S315, the print job is ended in the state where the heating element 54*b*2 is selected.

A case where a print command is received when the thermistor temperature is higher than 50° C. will be described.

If large-sized sheets are specified by the print job (YES in step S318), the processing proceeds to step S319. In step S319, operation is performed to obtain information about which heating element is selected, the heating element 54*b*1 or the heating element 54*b*2. If the heating element 54*b*1 is selected (YES in step S319), the processing proceeds to step S320. In step S320, energizing the heating element 54*b*1 and rotating the fixing motor 100 are started without switching the power supply line 500 to the heating element 54*b*1. If the heating element 54*b*2 is selected (NO in step S319), the processing proceeds to step S321. In step S321, the switching unit 57 switches the power supply line 500 from the heating element 54*b*2 to the heating element 54*b*1. In step S320, energizing the heating element 54*b*1 and rotating the fixing motor 100 are started. Since the fixing device 50 is already warm, the warmup time is shorter than 4.0 sec and does not constitute the rate-determining factor of the FPOT even if switching is performed between the heating elements 54*b*1 and 54*b*2. In step S322, fixing processing is performed by using the heating element 54*b*1. If the printing of the specified number of sheets to be printed is completed, then in step S323, energizing the heating element 54*b*1 and rotating the fixing motor 100 are stopped. In step S324, the print job is ended in the state where the heating element 54*b*1 is selected.

In step S318, in a case where small-sized sheets are specified by the print job (NO in step S318), the processing proceeds to step S325. In step S325, operation is performed to obtain information about which heating element is selected, the heating element 54*b*1 or the heating element 54*b*2. In a case where the heating element 54*b*2 is selected (NO in step S325), the processing proceeds to step S326. In step S326, energizing the heating element 54*b*2 and rotating the fixing motor 100 are simply started. If the heating element 54*b*1 is selected (YES in step S325), the processing proceeds to step S327. In step S327, the switching unit 57 switches the power supply line 500 from the heating element 54*b*1 to the heating element 54*b*2. In step S326, energizing the heating element 54*b*2 and rotating the fixing motor 100 are started. In step S328, fixing processing is performed by using the heating element 54*b*2. In a case where the printing of the specified number of sheets to be printed is completed, then in step S329, energizing the heating element 54*b*2 and rotating the fixing motor 100 are stopped. In step S330, the print job is ended in the state where the heating element 54*b*2 is selected.

As described above, the present exemplary embodiment provides the effect that the warmup time of the fixing device 50 can be reduced, like the first exemplary embodiment. The configuration in which grease is applied to the inner surface of the film 51 further provides the effect of preventing film deformation. There is an additional effect that the number of times the switching unit 57 produces switching noise can be reduced by reducing the number of times of switching performed by the switching unit 57, compared to the first exemplary embodiment. Another effect is that the life of the switching unit 57 is extended.

Table 3 shows whether switching between the heating elements 54*b* and 54*b*2 need to be performed and the resulting warmup times according to the flowchart illustrated in FIG. 10.

TABLE 3

| Selection of Heating Element in Passing Sheets | | | | | | | |
|---|---|---|---|---|---|---|---|
| | | Selection of heating element | | | | Switching between heating | |
| Thermistor Temperature | Sheet size | Standby period | Warmup period | Fixing processing period | End period | elements in starting warmup | Warmup time |
| ≤50° C. | Large-sized sheets | 54b1 | 54b1 | 54b1 | 54b1 | Not needed | 4.0 sec |
| | Small-sized sheets | 54b1 | 54b1 | 54b1 → 54b2 | 54b2 | Not needed | 4.0 sec |
| >50° C. | Large-sized sheets | 54b1 | 54b1 | 54b1 | 54b1 | Not needed | 4.0 sec |
| | | 54b2 | 54bl | 54b1 | 54b1 | Needed | 4.0 sec |
| | Small-sized sheets | 54b 1 | 54b2 | 54b2 | 54b2 | Needed | 4.0 sec |
| | | 54b2 | 54b2 | 54b2 | 54b2 | Not needed | 4.0 sec |

As shown in Table 3, in the second exemplary embodiment, like the first exemplary embodiment, the warmup time is minimized and does not constitute the rate-determining factor of the FPOT in any of the cases. The film 51 is not deformed in any of the cases. The number of times the switching unit 57 performs switching can be made smaller than that in the first exemplary embodiment.

In the second exemplary embodiment, the switching unit 57 performs the switching operation in a case where the thermistor temperature is lower than or equal to a predetermined temperature in the standby period. However, like the first exemplary embodiment, the switching operation may be performed while a driving motor of the image forming apparatus, such as the fixing motor 100, is rotating. In such a case, the effect of making the switching noise of the switching unit 57 less noticeable can also be obtained as in the first exemplary embodiment.

In the second exemplary embodiment, the switching of the switching unit 57 is performed based on the detection temperatures detected by the temperature detection members. However, a temperature prediction unit may be provided and the switching may be performed based on predicted temperatures. For example, the CPU 94 serving as the temperature prediction unit predicts the temperature of the heater 54 according to the number of sheets to be printed, the size of the heating element used, and the elapsed time since the last printing. In a case where a difference between the predicted temperatures at the longitudinal end and the longitudinal center portion of the heater 54 is predicted to be 50° C. or less, the CPU 94 may switch the power supply line 500 to the heating element **54*b*1 by using the switching unit 57**.

In the second exemplary embodiment, the degree of warming of the fixing device 50 is determined by using the two thermistors, i.e., the main thermistor 59 and the sub thermistor 60. However, the degree of warming may be determined by using either one of the main thermistor 59 and the sub thermistor 60.

In another exemplary embodiment, the switching unit 57 may be configured to switch the power supply line 500 to the heating element **54*b*1 having the largest longitudinal length when the fixing device 50 enters a power saving mode. The power saving mode refers to a mode in which the engine controller 92 performs control to supply power to only needed portions or reduce the supplied power to suppress power consumption of the image forming apparatus. In the power saving mode, a film unit including the film 51 is separated away from the pressure roller 53. By such a configuration, similar effects to those of the first exemplary embodiment can be obtained even if a print command is received in the power saving mode. Like the first exemplary embodiment, the fixing device 50 may be configured such that the switching unit 57 switches the power supply line 500 to the heating element 54*b*1 while power supply is stopped. Such a configuration eliminates the need to supply power to the switching unit 57** in the power saving mode, whereby an effect of suppressing power consumption can also be obtained.

According to an exemplary embodiment of the present disclosure, an image forming apparatus includes a fixing unit configured to be capable of exclusively switching a plurality of heating elements having different longitudinal lengths, in which the time needed to switch the heating elements can be reduced to reduce the warmup time of the fixing unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-226895, filed Nov. 27, 2017, which is hereby incorporated by reference herein in its entirety.

What is claimed is:

1. An image forming apparatus comprising:

an image forming unit configured to form an image on a recording material;

a fixing unit including a rotation member and a heater configured to heat the rotation member, the heater including a plurality of heating elements including a first heating element and a second heating element having a length smaller than a length of the first heating element in a longitudinal direction of the rotation member, the fixing unit being configured to perform fixing processing to fix the image to the recording material by using heat of the heater, via the rotation member; and a switching unit configured to switch a power supply line so that power is suppliable to any one of the plurality of heating elements, wherein, in a case where the fixing processing ends in a state where the power supply line is switched by the switching unit according to a first print command so that power is suppliable to the second heating element, the switching unit switches the power supply line from the second heating element to the first heating element so that power is suppliable to the first heating element, the switching occurring regardless of presence or absence of reception of a second print command subsequent to the first print command.

2. The image forming apparatus according to claim 1, wherein image formation according to the first print command is ended in response to the switching unit switching the power supply line from the second heating element to the first heating element so that power is suppliable to the first heating element.

3. The image forming apparatus according to claim 1, wherein the switching unit is a relay provided in a circuit for supplying power to the heater, and wherein the power supply line is switched from the second heating element to the first heating element so that power is suppliable to the first heating element, in a state where no power is supplied to the relay.

4. The image forming apparatus according to claim 1, wherein in a case where the second print command is a command to continuously perform image formation on a plurality of small-sized recording materials, fixing processing is first performed on a predetermined number of recording materials by using the first heating element, and then the switching unit switches the power supply line so that power is suppliable to the second heating element, and the fixing processing is performed on a remaining number of recording materials.

5. The image forming apparatus according to claim 1, further comprising a driving source configured to transmit driving force to the rotation member, wherein the switching unit is configured to switch the power supply line while the driving source is rotating.

6. The image forming apparatus according to claim 1, wherein the heater includes a substrate, and wherein the first heating element and the second heating element are formed on the substrate.

7. The image forming apparatus according to claim 6, wherein the rotation member is a cylindrical film, and the heater is in contact with an inner surface of the film.

8. The image forming apparatus according to claim 7, wherein the fixing unit includes a roller configured to form a nip portion with the heater via the film, the fixing unit being configured to convey and heat the recording material on which the image is formed, at the nip portion.

9. An image forming apparatus comprising:

an image forming unit configured to form an image on a recording material;

a fixing unit including a rotation member and a heater configured to heat the rotation member, the heater including a plurality of heating elements including a first heating element and a second heating element having a length smaller than that of the first heating element in a longitudinal direction of the rotation member, the fixing unit being configured to perform fixing processing to fix the image to the recording material by using heat of the heater, via the rotation member;

a switching unit configured to switch a power supply line so that power is suppliable to any one of the plurality of heating elements;

a detection unit configured to detect a temperature of the fixing unit; and a control unit configured to determine whether to switch the power supply line according to a temperature detection result of the detection unit, wherein the control unit is configured to, in a case where the temperature detection result is higher than a predetermined temperature and the recording material on which the image is to be formed has a first size, switch the power supply line so that power is suppliable to the first heating element, and in a case where the temperature detection result is higher than the predetermined temperature and the recording material on which the image is to be formed has a second size smaller than the first size, switch the power supply line so that power is suppliable to the second heating element.

10. The image forming apparatus according to claim 9, wherein the control unit is configured to, in a case where the temperature detection result is lower than or equal to a predetermined temperature, switch the power supply line so that power is suppliable to the first heating element.

* * * * *